US009028118B2

(12) United States Patent
Tajima et al.

(10) Patent No.: US 9,028,118 B2
(45) Date of Patent: May 12, 2015

(54) VEHICULAR HEADLAMP

(71) Applicant: Koito Manufacturing Co., Ltd., Tokyo (JP)

(72) Inventors: Takehiko Tajima, Shizuoka (JP); Akinori Matsumoto, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 114 days.

(21) Appl. No.: 13/954,264

(22) Filed: Jul. 30, 2013

(65) Prior Publication Data

US 2014/0036524 A1 Feb. 6, 2014

(30) Foreign Application Priority Data

Jul. 31, 2012 (JP) ..... 2012-169252

(51) Int. Cl.
*F21S 8/10* (2006.01)

(52) U.S. Cl.
CPC ..... *F21S 48/145* (2013.01); *F21S 48/1388* (2013.01); *F21S 48/1394* (2013.01)

(58) Field of Classification Search
CPC ..... F21S 48/145
USPC ..... 362/509, 516, 539
See application file for complete search history.

(56) References Cited

U.S. PATENT DOCUMENTS

2001/0019483 A1* 9/2001 Takada ..... 362/517
2007/0147062 A1 6/2007 Nino et al.
2011/0170308 A1* 7/2011 Kinoshita et al. ..... 362/516

FOREIGN PATENT DOCUMENTS

JP 4579154 B2 11/2010

* cited by examiner

*Primary Examiner* — David V Bruce
(74) *Attorney, Agent, or Firm* — Osha Liang LLP

(57) ABSTRACT

A vehicular headlamp has a projection lens, a light source disposed behind a rear focal point of the projection lens, and a reflector that reflects light from the light source forward. The vehicular headlamp forms a forward light distribution pattern. The vehicular headlamp includes a plate-like shade having a front-end portion positioned in the vicinity of the rear focal point of the projection lens to form a cut-off line of the forward light distribution pattern. The shade extends rearward and obliquely downward from the front-end portion. An overhead sign reflective surface is provided on a lower surface of the shade. The overhead sign reflective surface reflects light from the reflector toward the projection lens to form a part of an overhead sign distribution pattern. A dark portion forming portion is formed on the overhead sign reflective surface.

16 Claims, 5 Drawing Sheets

VEHICULAR HEADLAMP

BACKGROUND

1. Technical Field

The present invention relates to a vehicular headlamp.

2. Description of the Related Art

Patent Document 1 describes an example of a vehicular headlamp capable of forming an overhead sign distribution pattern that illuminates a sign positioned above and ahead of a vehicle (overhead sign) etc. during travel of the vehicle.

Patent Document 1: Japanese Patent No. 4579154

SUMMARY

In such an overhead sign distribution pattern, the illuminance is reduced in a certain region called "eye point" in order not to radiate bright light to the eyes of a driver of an oncoming vehicle (in order to prevent giving glare). In the vehicular headlamp described in Patent Document 1, a part of light to reach the eye point is blocked by the distal-end portion of an additional shielding portion to reduce the illuminance at the eye point.

The distal-end portion of the additional shielding portion is disposed in the vicinity of the rear focal point of a projection lens, and therefore the outline of the additional shielding portion may be clearly projected forward of the lamp to form an unnatural light distribution pattern. In addition, a dark portion formed by a member that supports the distal-end portion of the additional shielding portion blocking light is also projected forward of the lamp, which may also form an unnatural light distribution pattern. Further, the additional shielding portion is formed separately from a shade that forms a low-beam distribution pattern and a contrast boundary forming plate, which increases the number of components of the lamp.

One or more embodiments of the present invention provides a vehicular headlamp that is composed of a small number of components and that enables an overhead sign to be seen naturally.

A vehicular headlamp according to one or more of the present invention comprises a projection lens; a light source disposed in rear of a rear focal point of the projection lens; and a reflector that reflects light from the light source forward, the vehicular headlamp forming a forward light distribution pattern, characterized in that the vehicular headlamp includes a plate-like shade having a front-end portion positioned in the vicinity of the rear focal point of the projection lens to form a cut-off line of the forward light distribution pattern, the shade extending rearward and obliquely downward from the front-end portion; an overhead sign reflective surface is provided on a lower surface of the shade, the overhead sign reflective surface reflecting light from the reflector toward the projection lens to form a part of an overhead sign distribution pattern; and a dark portion forming portion is formed on the overhead sign reflective surface, the dark portion forming portion making a portion of the overhead sign distribution pattern corresponding to an eye point of a driver of an oncoming vehicle darker than around the eye point.

In a vehicular headlamp according to one or more embodiments of the present invention, the dark portion forming portion may be formed at a position spaced rearward from the rear focal point of the projection lens.

In a vehicular headlamp according to one or more embodiments of the present invention, the dark portion forming portion may be a projecting portion that projects downward.

In a vehicular headlamp according to one or more embodiments of the present invention, the dark portion forming portion may be formed in an elongated shape to extend in a longitudinal direction.

In a vehicular headlamp according to one or more embodiments of the present invention, the dark portion forming portion may diffuse or absorb light from the reflector to make the eye point darker than around the eye point.

According to one or more embodiments of the present invention, the dark portion forming portion which darkens the eye point of a driver of an oncoming vehicle is formed on the overhead sign reflective surface which forms an overhead sign distribution pattern. This makes it possible to provide a vehicular headlamp composed of a small number of components and capable of forming an overhead sign distribution pattern in which the eye point has been darkened. In addition, a dark portion due to a member other than the dark portion forming portion is not projected on the overhead sign distribution pattern. This makes it possible to form an overhead sign distribution pattern that provides natural vision that does not give an uncomfortable feeling.

DETAILED DESCRIPTION

A vehicular headlamp according to embodiments of the present invention will be described below with reference to the accompanying drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
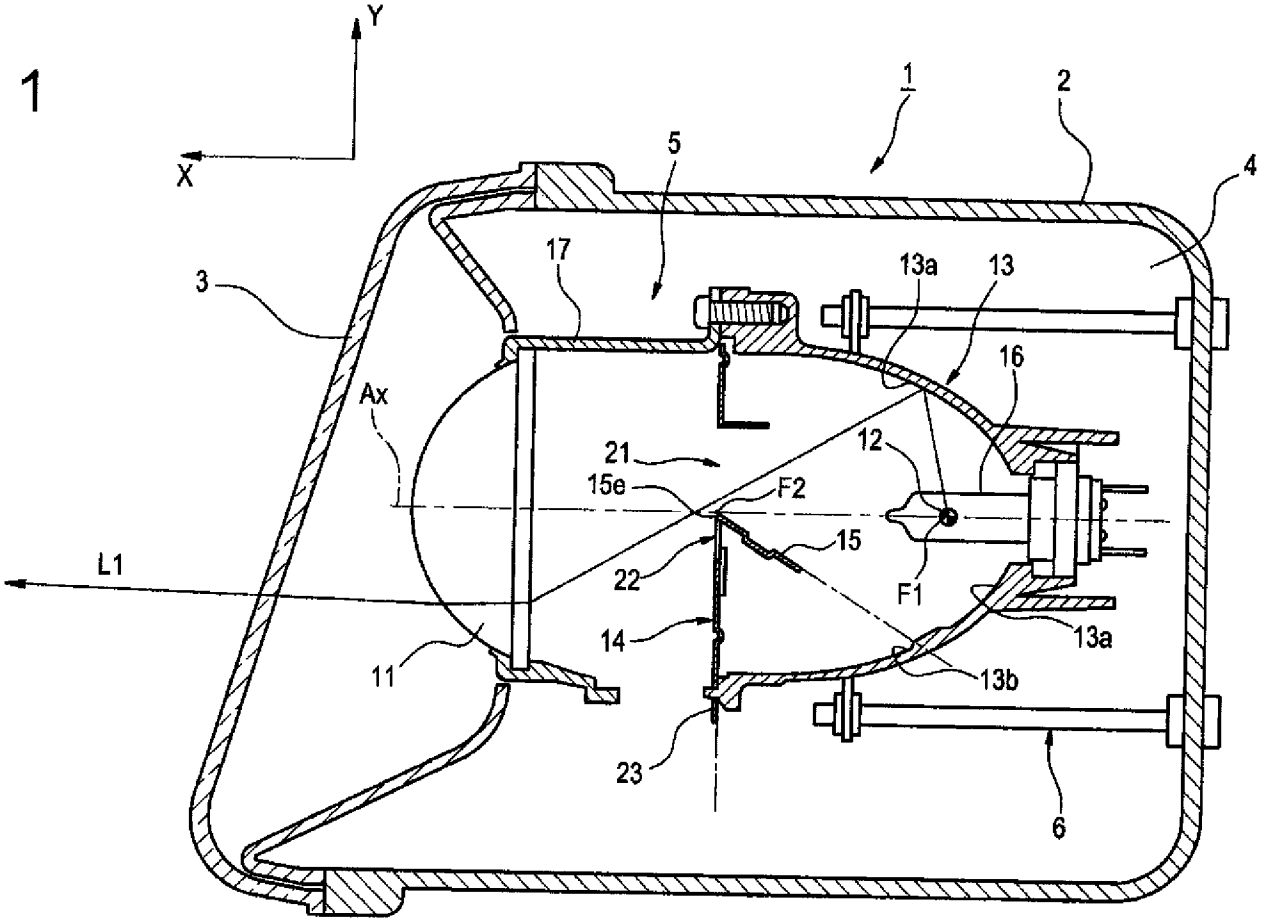
FIG. 1 is a sectional view of a vehicular headlamp according to one or more embodiments of the present invention.

FIG. 1 is a sectional view of a vehicular headlamp 1. The vehicular headlamp 1 includes a lamp body 2 having an opening portion that opens forward of the lamp, and a cover (outer cover) 3 made of a transparent resin and attached to the opening portion. The outer cover 3 is disposed to close the opening portion of the lamp body 2 from the front, and forms a lamp chamber 4 together with the lamp body 2. In the following description, the direction of the arrow X shown in FIG. 1 is referred to as "forward", and the direction of the arrow Y is referred to as "above".

A lamp unit 5 is disposed in the lamp chamber 4. The lamp unit 5 is supported by the lamp body 2 via an aiming mechanism 6. The direction of an optical axis Ax of the lamp unit 5 is adjustable by means of the aiming mechanism 6.

The lamp unit 5 includes a projection lens 11 having the optical axis Ax extending in the vehicular longitudinal direction, a light source 12 disposed in rear of a rear focal point F2 of the projection lens 11, a reflector 13 that reflects light from the light source 12 forward and closer to the optical axis Ax, and a first shade 14 and a second shade 15 disposed between the light source 12 and the projection lens 11.

The light source 12 is a light emitting portion (filament) of a filament bulb 16, for example. In the embodiment, the filament bulb 16 is disposed with its long axis extending along the optical axis Ax. In addition, the filament bulb 16 is attached to the reflector 13 such that the light source 12 is positioned on the optical axis Ax extending in the vehicular longitudinal direction. A discharge bulb, an LED, an organic EL, etc. may also be employed as the light source 12.

The reflector 13 includes a first reflective surface 13*a* and a second reflective surface 13*b* provided at a part of the outer periphery of the first reflective surface 13*a*. The first reflective surface 13*a* generally has the shape of a spheroid about the optical axis Ax. The first reflective surface 13*a* has a first focal point F1 generally matching the light source 12, and a second focal point generally matching the rear focal point F2 of the projection lens 11 to be discussed later. Consequently, the first reflective surface 13*a* reflects light from the light source 12 forward and closer to the optical axis Ax.

The second reflective surface 13*b* is provided at the lower portion of the outer periphery of the first reflective surface 13*a*. The second reflective surface 13*b* reflects light from the light source 12 toward an OHS reflective surface 15*c* or a second opening 22 to be discussed later.

The projection lens 11 is fixed to the front-end portion of the reflector 13 via a lens holder 17. The projection lens 11 is a planoconvex lens with a convex front-side surface and a flat rear-side surface. As discussed above, the projection lens 11 is disposed such that the rear focal point F2 generally matches the second focal point of the first reflective surface 13*a* of the reflector 13.

The lens holder 17 is a tubular member that extends forward from the front-end opening portion of the reflector 13. The rear-end portion of the lens holder 17 is screwed to the reflector 13.

The first shade 14 and the second shade 15 are formed by punching and bending a metal plate. The first shade 14 is fixed between the lens holder 17 and the reflector 13 to extend perpendicularly to the optical axis Ax. In addition, the first shade 14 is disposed at a position generally matching the second focal point of the first reflective surface 13*a* (rear focal point F2 of the projection lens 11) in the longitudinal direction of the optical axis Ax.

Figure 2:
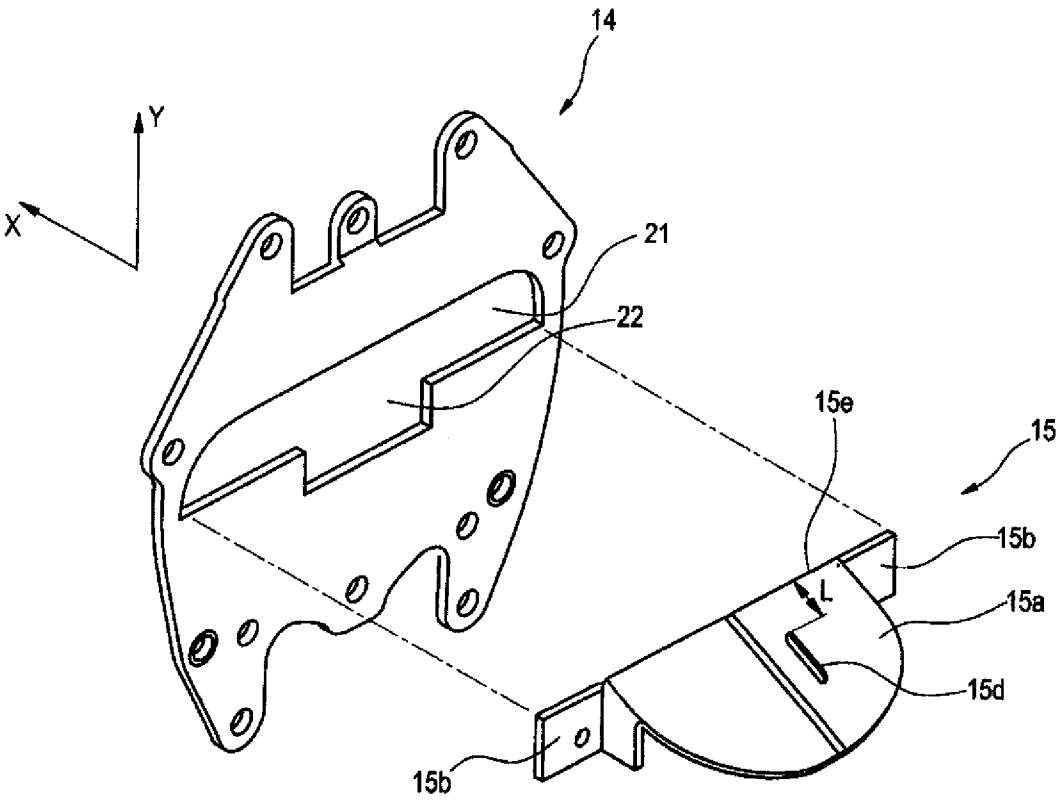
FIG. 2 is an exploded perspective view of a first shade and a second shade.
Figure 3:
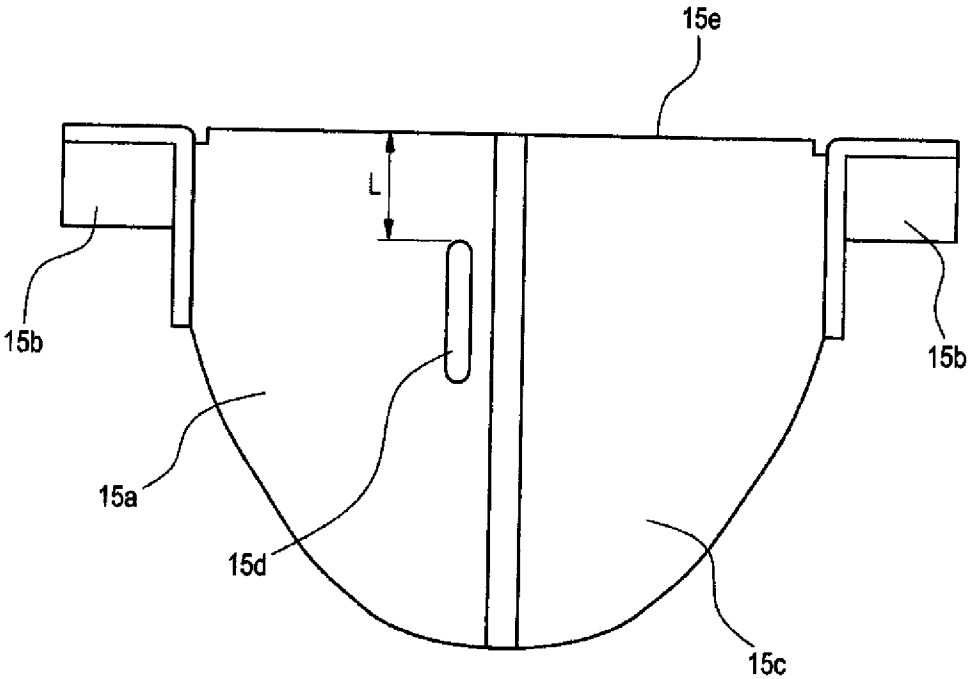
FIG. 3 is a bottom view of the second shade.

FIG. 2 is an exploded perspective view of the first shade 14 and the second shade 15. FIG. 3 is a bottom view of the second shade 15.

As shown in FIG. 2, the first shade 14 is provided with a first opening 21 that is transversely long, and a second opening 22 that is narrower than the first opening 21. Light reflected from the reflector 13 passes through the first opening 21 and the second opening 22 to be radiated forward of the lamp via the projection lens 11.

The second shade 15 includes a plate-like (tongue-shaped) body portion 15*a* that extends rearward and obliquely downward, and attachment portions 15*b* that extend toward both sides from the body portion 15*a*. The second shade 15 is fixed to the first shade 14 with the attachment portion 15*b* welded to the back surface of the first shade 14.

A front-end portion 15*e* of the second shade 15 has a stepped shape in which the right side is higher than the left side as seen from the rear of the optical axis Ax. The second shade 15 is attached to the first shade 14 such that the front-end portion 15*e* extends along the boundary between the first opening 21 and the second opening 22 of the first shade 14. In addition, the front-end portion 15*e* is disposed at a position in the vicinity of the rear focal point F2 of the projection lens 11.

The lower surface of the body portion 15*a* has been subjected to a reflective surface process to form the OHS reflective surface 15*c* which forms a part of an overhead sign distribution pattern (hereinafter abbreviated as "OHS distribution pattern") as discussed later. In addition, a dark portion forming portion 15*d* to be discussed in detail later is provided in a part of the OHS reflective surface 15*c*.

Figure 4:
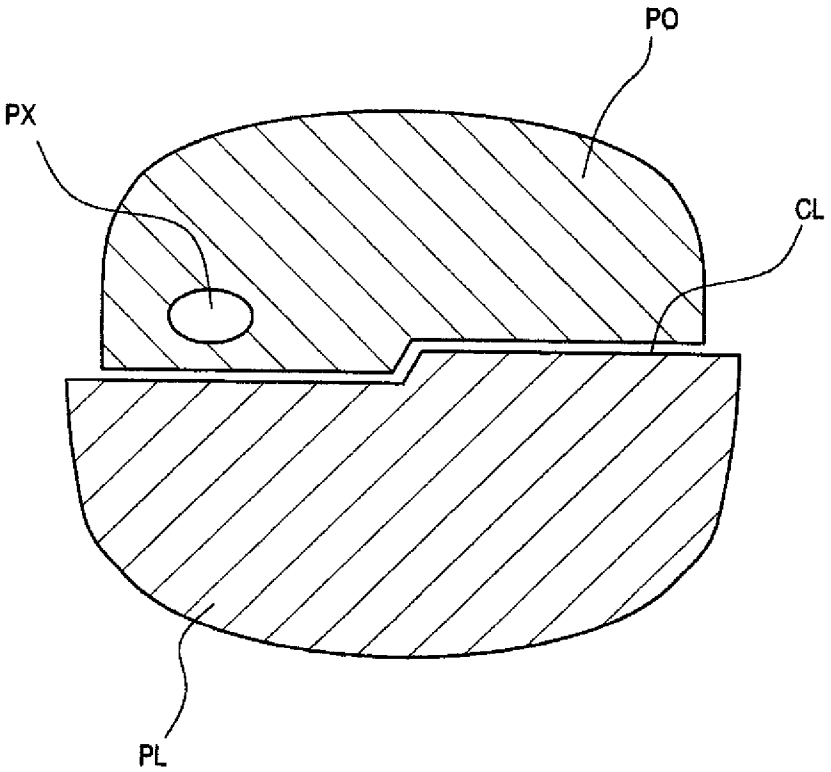
FIG. 4 shows a forward light distribution pattern formed by the vehicular headlamp.

Next, a low-beam distribution pattern PL serving as a forward light distribution pattern will be described. As shown in FIG. 1, light L1 emitted from the light source 12 and reflected by the first reflective surface 13*a* of the reflector 13 passes through the first opening 21 of the first shade 14 to form the low-beam distribution pattern PL shown in FIG. 4. FIG. 4 shows a light distribution pattern formed on a virtual vertical screen provided at a distance of about 25 m ahead of the lamp.

The front-end portion 15*e* of the second shade 15 is positioned at the lower end of the first opening 21. In addition, the front-end portion 15*e* generally matches the rear focal point F2 of the projection lens 11. Therefore, when an image in the vicinity of the rear focal point F2 is projected ahead of the lamp in a vertically and laterally inverted manner by the projection lens 11, the outline of the front-end portion 15*e* forms a clear cut-off line CL positioned at the upper end of the low-beam distribution pattern PL.

In the embodiment, as discussed above, the front-end portion 15*e* of the second shade 15 has a stepped shape in which the right side is higher than the left side as seen from the rear. Therefore, as shown in FIG. 4, the cut-off line CL is formed such that the low-beam distribution pattern PL has a stepped shape in which the left side is lower than the right side. The thus shaped low-beam distribution pattern PL is used in an area in which an oncoming vehicle passes on the left side of a host vehicle.

Figure 5:
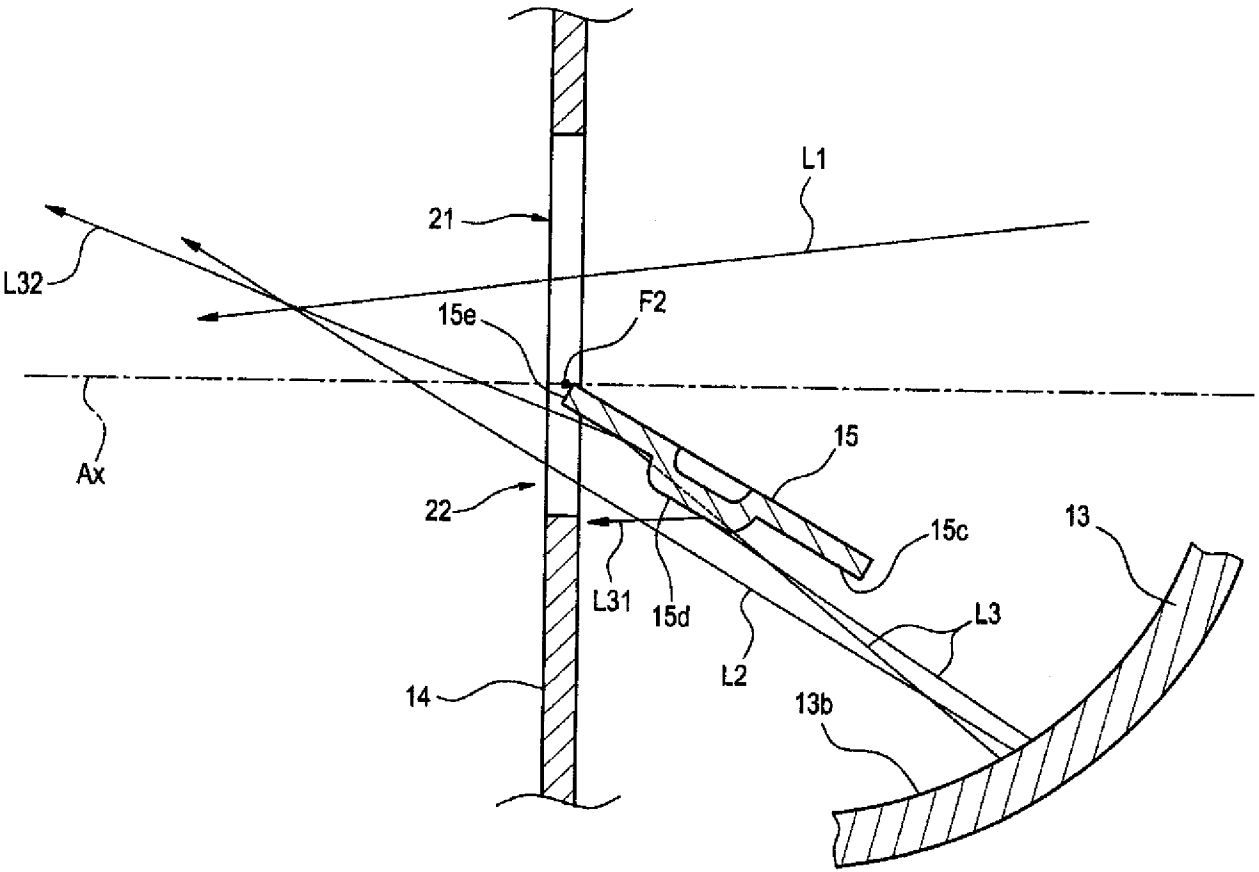
FIG. 5 is a schematic view illustrating the paths of light in the vicinity of the first shade and the second shade.

Next, an OHS distribution pattern PO will be described with reference to FIG. 5. FIG. 5 is a schematic view illustrating the paths of light in the vicinity of the first shade 14 and the second shade 15. As shown in FIG. 5, a part of light L2 emitted from the light source 12 and reflected by the second reflective surface 13*b* of the reflector 13 directly passes through the second opening 22. In addition, another part of light L3 emitted from the light source 12 and reflected by the second reflective surface 13*b* of the reflector 13 is reflected by the OHS reflective surface 15*c* to pass through the second opening 22. A light beam L32 in FIG. 5 passes through a side of the dark portion forming portion 15*d* (back side with respect to the sheet surface corresponding to the section shown in FIG. 5) and is reflected by the OHS reflective surface 15*c* to pass through the second opening 22.

The second opening 22 is provided below the first opening 21. Therefore, when the light L2 and L3 is projected by the projection lens 11, the OHS distribution pattern PO positioned above the low-beam distribution pattern PL is formed as shown in FIG. 4. Consequently, a sign or the like positioned above and not illuminated with the low-beam distribution pattern PL can be illuminated with the OHS distribution pattern PO.

The area of the second reflective surface 13*b* is set to be smaller than the area of the first reflective surface 13*a*. Consequently, the intensity of light passing through the second opening 22 is lower than the intensity of light passing through the first opening 21, and the illuminance of the OHS distribution pattern PO is lower than that of the low-beam distribution pattern PL.

Again, the area of the second reflective surface 13*b* is set to be smaller than the area of the first reflective surface 13*a*. Consequently, the intensity of light reflected by the second reflective surface 13*b* is lower than the intensity of light reflected by the first reflective surface 13*a*. In addition, the second focal point of the second reflective surface 13*b* is disposed at a position shifted downward with respect to the rear focal point F2 of the projection lens 11. Consequently, light reflected by the second reflective surface 13*b* is projected with a light source image blurred and enlarged. Thus, the OHS distribution pattern PO is formed ahead of the lamp as a blurred light distribution pattern with lower light intensity than that of the low-beam distribution pattern PL.

According to one or more embodiments of the present invention, in the thus formed OHS distribution pattern PO, only extremely weak light is radiated to an eye point Px in order not to give glare to the driver of an oncoming vehicle. Therefore, in the vehicular headlamp 1 according to the embodiment, the dark portion forming portion 15*d* which makes the eye point Px darker than around the eye point Px is formed on the OHS reflective surface 15*c* which forms a part of the OHS distribution pattern PO. The eye point Px corresponds to a region on the virtual screen discussed earlier in which the eyes of the driver of an oncoming vehicle is positioned.

The dark portion forming portion 15*d* is provided at such a position that the light L3 would be reflected toward the eye point Px if the dark portion forming portion 15*d* were not provided but a reflective surface were provided in place of the dark portion forming portion 15*d*. The dark portion forming portion 15*d* reduces light directed toward the eye point Px to make the eye point Px darker than a portion of the OHS distribution pattern PO around the eye point Px.

In the embodiment, as shown in FIG. 5, the dark portion forming portion 15*d* is a projecting portion formed on the OHS reflective surface 15*c* to project downward. The projecting portion can be easily formed by punching, for example. In addition, according to one or more embodiments of the present invention, as shown in FIG. 2, the dark portion forming portion 15*d* is provided at a position spaced rearward from the rear focal point of the projection lens 11 (position at a spacing distance L).

Of the light L3 incident on the OHS reflective surface 15*c*, light L31 incident on the dark portion forming portion 15*d* is diffused in the lateral direction of the lamp by the surface of the dark portion forming portion 15 so that most of the light incident on the dark portion forming portion 15*d* does not pass through the second opening 22. Consequently, it is possible to reduce light directed toward the eye point Px of the driver of an oncoming vehicle, thereby making the eye point Px darker than a portion of the OHS distribution pattern PO around the eye point Px.

In the vehicular headlamp 1 according to the embodiment described above, the dark portion forming portion 15*d* which makes the eye point Px darker than around the eye point Px is provided on the OHS reflective surface 15*c* of the second shade 15. This eliminates the need for a member that supports the dark portion forming portion 15*d* as in Patent Document 1. Thus, it is possible to provide the vehicular headlamp 1 composed of a smaller number of components and capable of forming the OHS distribution pattern PO.

In addition, the dark portion forming portion 15*d* is formed integrally with the reflective surface 15*c*, which eliminates the need for a member that supports the dark portion forming portion 15*d* as in Patent Document 1. Thus, a shadow of a member that supports the dark portion forming portion is not projected forward of the lamp. Thus, only the low-beam distribution pattern PL and the OHS distribution pattern PO in which the eye point Px has been darkened are formed forward of the lamp. Consequently, it is possible to form a light distribution pattern that provides natural vision that does not give a user an uncomfortable feeling.

In addition, the front end of the dark portion forming portion 15*d* is formed at a position spaced rearward from the rear focal point F2 of the projection lens 11. Therefore, a clear shadow of the outline of the dark portion forming portion 15*d* is not projected forward of the lamp. That is, the boundary between bright and dark portions is blurred in the light projected forward of the lamp, and therefore the dark portion at the eye point Px is not conspicuous unnaturally. Thus, it is possible to form the OHS distribution pattern PO which provides natural vision that does not give a user an uncomfortable feeling.

In the case where a projecting portion is formed as the dark portion forming portion 15*d* as in the embodiment, the dark portion forming portion 15*d* can be formed at the same time as the second shade 15 is pressed, which facilitates processing. Thus, it is possible to form the dark portion forming portion 15*d* without preparing a special process, and thus to provide the vehicular headlamp 1 capable of forming the OHS distribution pattern PO at a low cost.

The vehicular headlamp 1 is not limited to the embodiment discussed earlier, and may be modified, improved, etc. as appropriate.

For example, although the dark portion forming portion 15*d* is formed as a projecting portion in the embodiment discussed above, embodiments of the present invention is not limited thereto. For example, the dark portion forming portion 15*d* may be formed as a recessed portion or a succession of recessed and projecting portions that is formed in the OHS reflective surface 15*c*. Alternatively, the dark portion forming portion 15*d* may be formed by performing a graining process or a surface roughening process on a part of the OHS reflective surface 15*c*.

In such cases, the eye point Px is darkened with the dark portion forming portion 15*d* diffusing light in directions other than the direction of the eye point Px. If light is diffused by the dark portion forming portion 15*d* to darken the eye point Px, it is easy to form the OHS distribution pattern PO which provides natural vision in which the light intensity is gradually lowered toward around the eye point Px.

Alternatively, the dark portion forming portion 15*d* may be formed by applying or printing a paint with high absorbance, or affixing a laser mark to burn a part of the OHS reflective surface 15*c*. In this case, the dark portion forming portion 15*d* absorbs light to darken the eye point. Also in this case, the dark portion forming portion 15*d* can be formed easily.

In the embodiment discussed above, the dark portion forming portion 15*d* is formed in an elongated shape to extend in the longitudinal direction in accordance with the shape of the filament extending in the longitudinal direction of the filament bulb 16. This makes it possible to efficiently diffuse light directed from the light source 12 toward the eye point Px, and to efficiently darken the eye point Px. The dark portion forming portion 15*d* may be shaped variously in accordance with the shape of the light source 12. For example, in the case where an LED array in which a plurality of LEDs are arranged in the transverse direction is used as the light source, the dark portion forming portion 15*d* may also be shaped to extend in the transverse direction.

As discussed above, the vehicular headlamp 1 can form a low-beam distribution pattern for use in an area in which an oncoming vehicle passes on the left side of the host vehicle. However, embodiments of the present invention is not limited thereto. It is possible to form the vehicular headlamp 1 which forms a variety of light distribution patterns as the forward light distribution pattern, such as a low-beam distribution pattern for use in an area in which an oncoming vehicle passes on the right side of the host vehicle, by changing the shape of the front-end portion 15*e* of the second shade 15.

As discussed above, the vehicular headlamp 1 forms the low-beam distribution pattern PL and the OHS distribution pattern PO as the forward light distribution pattern. However, the present invention is not limited thereto. For example, one or more embodiments of the present invention may be applied to a vehicular headlamp that forms a fog lamp distribution pattern having a cut-off line and the OHS distribution pattern PO as the forward light distribution pattern.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF THE REFERENCE NUMERALS

1 VEHICULAR HEADLAMP
2 LAMP BODY
3 OUTER COVER
4 LAMP CHAMBER
5 LAMP UNIT
11 PROJECTION LENS
12 LIGHT SOURCE
13 REFLECTOR
13*a* FIRST REFLECTIVE SURFACE
13*b* SECOND REFLECTIVE SURFACE
14 FIRST SHADE
15 SECOND SHADE
15*a* BODY PORTION
15*b* ATTACHMENT PORTION
15*c* OHS REFLECTIVE SURFACE
15*d* DARK PORTION FORMING PORTION
15*e* FRONT-END PORTION
21 FIRST OPENING
22 SECOND OPENING

What is claimed is:

1. A vehicular headlamp comprising:
a projection lens;
a light source disposed behind a rear focal point of the projection lens; and
a reflector that reflects light from the light source forward,
wherein the vehicular headlamp forms a forward light distribution pattern,
wherein the vehicular headlamp includes a plate-like shade having a front-end portion positioned in the vicinity of the rear focal point of the projection lens to form a cut-off line of the forward light distribution pattern,
wherein the shade extends rearward and obliquely downward from the front-end portion,
wherein an overhead sign reflective surface is provided on a lower surface of the shade,
wherein the overhead sign reflective surface reflects light from the reflector toward the projection lens to form a part of an overhead sign distribution pattern,
wherein a dark portion forming portion is formed on the overhead sign reflective surface, and
wherein the dark portion forming portion forms a first portion of the overhead sign distribution pattern corresponding to an eye point of a driver of an oncoming vehicle to be darker than a second portion around the eye point.

2. The vehicle headlamp according to claim 1, wherein the dark portion forming portion is formed at a position spaced rearward from the rear focal point of the projection lens.

3. The vehicular headlamp according to claim 1, wherein the dark portion forming portion is a projecting portion that projects downward.

4. The vehicular headlamp according to claim 1, wherein the dark portion forming portion is formed in an elongated shape to extend in a longitudinal direction.

5. The vehicular headlamp according to claim 1, wherein the dark portion forming portion diffuses or absorbs light from the reflector to make the first portion darker than the second portion.

6. The vehicular headlamp according to claim 2, wherein the dark portion forming portion is a projecting portion that projects downward.

7. The vehicular headlamp according to claim 2, wherein the dark portion forming portion is formed in an elongated shape to extend in a longitudinal direction.

8. The vehicular headlamp according to claim 3, wherein the dark portion forming portion is formed in an elongated shape to extend in a longitudinal direction.

9. The vehicular headlamp according to claim 6, wherein the dark portion forming portion is formed in an elongated shape to extend in a longitudinal direction.

10. The vehicular headlamp according to claim 2, wherein the dark portion forming portion diffuses or absorbs light from the reflector to make the first portion darker than the second portion.

11. The vehicular headlamp according to claim 3, wherein the dark portion forming portion diffuses or absorbs light from the reflector to make the first portion darker than the second portion.

12. The vehicular headlamp according to claim 4, wherein the dark portion forming portion diffuses or absorbs light from the reflector to make the first portion darker than the second portion.

13. The vehicular headlamp according to claim 6, wherein the dark portion forming portion diffuses or absorbs light from the reflector to make the first portion darker than the second portion.

14. The vehicular headlamp according to claim 7, wherein the dark portion forming portion diffuses or absorbs light from the reflector to make the first portion darker than the second portion.

15. The vehicular headlamp according to claim 8, wherein the dark portion forming portion diffuses or absorbs light from the reflector to make the first portion darker than the second portion.

16. The vehicular headlamp according to claim 9, wherein the dark portion forming portion diffuses or absorbs light from the reflector to make the first portion darker than the second portion.

* * * * *